US011154763B1

(12) United States Patent
Lay

(10) Patent No.: US 11,154,763 B1
(45) Date of Patent: Oct. 26, 2021

(54) HARNESS SYSTEM FOR CONNECTING A BARRIER TO AN OBJECT PROJECTING DEVICE USING A CONNECTOR WITH AN ADAPTABLE PERIPHERY

(71) Applicant: William Coleman Lay, St. George, UT (US)

(72) Inventor: William Coleman Lay, St. George, UT (US)

( * ) Notice: Subject to any disclaimer, the term of this patent is extended or adjusted under 35 U.S.C. 154(b) by 194 days.

(21) Appl. No.: 16/367,022

(22) Filed: Mar. 27, 2019

(51) Int. Cl.

| | |
|---|---|
| ***A63B 71/02*** | (2006.01) |
| *A63B 102/18* | (2015.01) |
| *A63B 102/02* | (2015.01) |
| *A63B 102/20* | (2015.01) |
| *A63B 102/14* | (2015.01) |
| *A63B 69/40* | (2006.01) |

(52) U.S. Cl.
CPC ..... *A63B 71/022* (2013.01); *A63B 69/40* (2013.01); *A63B 2102/02* (2015.10); *A63B 2102/14* (2015.10); *A63B 2102/18* (2015.10); *A63B 2102/182* (2015.10); *A63B 2102/20* (2015.10); *A63B 2209/10* (2013.01); *A63B 2225/09* (2013.01); *A63B 2243/007* (2013.01); *A63B 2243/0025* (2013.01)

(58) Field of Classification Search
CPC ..... A63B 71/022; A63B 2102/02; A63B 2102/14; A63B 2102/18; A63B 2102/182; A63B 2102/20; A63B 69/40; A63B 2209/10; A63B 2225/09; A63B 2243/0025; A63B 2243/007
USPC ..... 473/435
See application file for complete search history.

(56) References Cited

U.S. PATENT DOCUMENTS

| | | | |
|---|---|---|---|
| 2,939,467 | A | 6/1960 | Meyer et al. |
| 3,052,249 | A | 9/1962 | Seaman et al. |
| 3,222,067 | A | 12/1965 | Litwhiler et al. |
| 3,478,472 | A | 11/1969 | Kwake |
| 3,593,997 | A | 7/1971 | Boehner |
| 3,980,304 | A | 9/1976 | O'Neill et al. |
| 4,815,736 | A | 3/1989 | Wright |
| 4,890,834 | A | 1/1990 | Ponza |
| 5,088,740 | A | 2/1992 | Peterson |
| 5,359,986 | A | 11/1994 | Magrath, III et al. |
| 5,452,896 | A | 9/1995 | Core |
| 5,655,766 | A | 8/1997 | Klebe, Jr. |
| 6,082,350 | A | 7/2000 | Crews et al. |
| 6,102,021 | A | 8/2000 | Sanders et al. |
| 6,155,936 | A | 12/2000 | Dorr |
| 6,440,013 | B1 | 8/2002 | Brown |
| 6,443,140 | B1 | 9/2002 | Crews et al. |

(Continued)

*Primary Examiner* — Eugene L Kim
*Assistant Examiner* — Rayshun K Peng
(74) *Attorney, Agent, or Firm* — Madson IP, P.C.; Craig J. Madson

(57) ABSTRACT

A harness connection system connects a barrier to an object projecting device to permit an object, such as a ball, to be projected from an exit opening in the object projecting device and passed through an opening in the barrier. The harness connection system has a harness with a connector having an adaptable periphery, a fastener securing the connector to the barrier, and a receiving anchor that receives and secures the connector. To inhibit sagging of the barrier, a retractor is connected to the barrier and to a retractor receiver to draw the barrier taut and away from the exit opening of the object projecting device.

20 Claims, 9 Drawing Sheets

(56) References Cited

U.S. PATENT DOCUMENTS

| | | | | |
|---|---|---|---|---|
| 6,508,243 | B1 | 1/2003 | Long | |
| 6,546,924 | B2 | 4/2003 | Battersby et al. | |
| 7,156,761 | B2 | 1/2007 | Mesa | |
| 7,413,521 | B2 | 8/2008 | Cherry | |
| 7,686,712 | B2 | 3/2010 | Sifrit | |
| 8,172,703 | B2 * | 5/2012 | Lay | A63B 71/022 473/421 |
| 8,496,545 | B2 | 7/2013 | Lay | |
| 8,747,259 | B2 | 6/2014 | Lay | |
| 10,335,660 | B1 * | 7/2019 | Pizzirusso | A63B 71/023 |
| 2002/0098920 | A1 | 7/2002 | Bruyer et al. | |
| 2003/0195061 | A1 | 10/2003 | Brown | |
| 2005/0176518 | A1 | 8/2005 | Doherty et al. | |
| 2007/0123369 | A1 | 5/2007 | Cherry | |
| 2017/0142928 | A1 * | 5/2017 | Rust | A01K 5/008 |

* cited by examiner

HARNESS SYSTEM FOR CONNECTING A BARRIER TO AN OBJECT PROJECTING DEVICE USING A CONNECTOR WITH AN ADAPTABLE PERIPHERY

FIELD OF THE INVENTION

The present invention relates generally to facilitating the projection of an object from an object projecting device through a barrier. More specifically, the embodiments of the present invention relate to a harness system used to connect a barrier (such as a net or the like) to an object projecting device (such as a pitching machine or the like) so that an object (such as a ball) may be passed through the barrier while the barrier shields an operator of the object projecting device from being struck by the object.

BACKGROUND OF THE INVENTION

1. Field of the Invention

Various exemplary embodiments of the present invention are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "some embodiments," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

An earlier iteration of an apparatus for attaching a ball pitching machine having a housing and a ball outlet to a barrier netting using a rigid net harness is described and claimed in U.S. Pat. No. 8,747,259, issued Jun. 10, 2014 to the same inventor and entitled "Wind Resistant Practice Cage with Opening and Alternative Closures" (hereinafter referred to as "Lay '259 patent"). In order to streamline the description in this application, the contents of the Lay '259 patent is expressly incorporated into this application by this reference, as if fully recited herein.

2. The Relevant Technology

A batting cage (or tunnel) is an enclosed area for baseball or softball players to practice the skill of batting. The optimal material for batting cages is netting, and they are typically rectangular in shape. Chain-link fence is not required but can be useful to enclose the netting to prevent vandalism. However, this material typically is not suitable for the primary impact layer because it will warp the fencing and damage balls. The ideal netting for a batting cage is either diamond- or square-shaped.

Typical use of a batting cage has a batter standing at one end of the cage, with a pitching machine (or, less often, a human pitcher) at the opposing end. The pitcher or pitching machine pitches baseballs to the batter, who hits them. It is recommended to use a protective pitcher's L-screen to prevent batted balls from striking the pitcher or machine.

The cage is used to keep the loose baseballs within a certain range so that they're easy to pick up and are not lost.

Batting cages are found both indoors and outdoors. The interior floor of a batting cage may be sloped, to automatically feed the baseballs back into the automatic pitching machine. The automatic pitching machines using sloped floors usually pitch out a synthetic baseball or softball, rather than an official solid core leather hardball.

Commercial batting cages pitch with several different speeds, which can range from 30 miles (48 km) (for softball) to 90 miles (140 km) per hour.

Cricket nets and tunnels, used by cricket batsmen are similar in purpose, but bowling machines are much less common than facing a live bowler (this reflects the fact that nearly half of the members of a cricket team are specialist bowlers, and therefore proportionately more bowling practice is needed in cricket than pitching practice in baseball).

Many practice cages are erected outdoors. Thus, the cage is exposed to the elements including wind. Even though the projectile barriers (e.g., netting, fencing, and the like) may have holes, they still may be a barrier to wind. Also, practice cages that utilize pitching machines may require protection of the pitching machine from the elements. This protection may be removal of the pitching machine from outdoor exposure by lifting the barrier netting and carrying it indoors, applying a cover to enclose the pitching machine from the elements, or detaching it from the barrier, if it is attached, and removing to place it indoors or under cover or applying a cover.

For commercial practice cages or cages used by sports professionals, protection of the pitching machine may be permanently provided. However, for backyard, Little League, or even High School practice cages the expense of such protection may be prohibitive.

Hence, it would be an advance in the art to provide a harness system that easily is attachable and detachable from the object projecting device, whether it is a baseball, softball, football, tennis ball, cricket ball throwing machine, or any other type of object projecting device.

It would also be an advance in the art to provide a harness system that easily and cost-effectively may be manufactured into or retrofitted into the barrier to facilitate effective attachment and detachment of the object projecting device.

BRIEF SUMMARY OF THE INVENTION

The present exemplary embodiments constitute an advanced, yet simple and cost-effective harness system for connecting a barrier to an object projecting device. The exemplary harness systems of this disclosure may be manufactured and sold together with a barrier and an object projecting device or may be retrofit with existing barriers and/or object projecting devices.

For purposes of this disclosure, the term "barrier" shall mean anything that serves to bar passage of an object, such as a ball, including but not limited to a net or netting, canvas fabric, screen fabric (see-thru or not), poly mesh, trampoline mesh (including polypropylene trampoline fabric), impact-resistant perforated poly sheet, and the like. Also, the term "object projecting device" shall mean any type of pitching machine or throwing machine for any type of object (ball), including but not limited to baseballs, softballs, soccer balls, tennis balls, footballs, lite balls of any type, cricket balls, lacrosse balls, and the like. Additionally, the term "connector" may be any suitable device that connects the barrier to the object projecting device, and a connector having an adaptable periphery means that the connector has a characteristic of adapting to different-sized peripheries and may include, but not limited to, adjustable straps of any type (such as shoelaces, twine, or any type of cinching strap that could be tied, secured by hook and loop (e.g., Velcro®), snaps, buttons, a hook and eye latch, etc.) resilient rings, elastomeric bands, or the like.

In exemplary embodiments, a harness connection system for connecting a barrier to an object projecting device permits an object, such as a ball, to be projected from an exit opening in the object projecting device through an opening in the barrier. The harness connection system may comprise a harness having a connector, a fastener securing the connector to the barrier, and a receiving anchor that receives and secures the connector. The connector has an adaptable periphery (i.e., a periphery that is capable of being adjusted to readily address different conditions; for example, connector may have at least a portion that is resilient or elastomeric so to adapt to different-sized exit openings on object projecting devices, or the connector may be a strap, resilient or not, that can be fashioned into a loop defining a periphery by tying ends of the strap together or by using adjustable fastening such as snaps, hook and loop, and the like). The barrier has an opening of a size defined by the adaptable periphery of the connector and being large enough to permit at least a portion of the object projecting device to pass through the barrier. The connector of the harness connection system has a non-connection mode when the connector is detached from the object projection device and a connection mode when the connector connects the barrier to the object projecting device.

The receiving anchor may be at least a portion of the object projecting device, receiving and securing the connector to the object projecting device when in the connection mode so that the exit opening is on one side of the barrier and most of the object projecting device is on the other side (protected side) of the barrier, and the barrier serves to protect the object projecting device and persons on the protected side of the barrier. Depending on the size of the receiving anchor, the connector (and the opening in the barrier that is defined thereby) may expand to surround the receiving anchor and then contract or be tied or cinched tight to secure the connector to the receiving anchor of the object projecting device. Hence, the size of the opening in the barrier has a first size when the connector is in the non-connection mode and the size of the opening in the barrier has a second size when the connector is in the connection mode.

In some exemplary embodiments, the barrier is a net or netting configured into any of a number of shapes and sizes such as a cage-type barrier, an L-screen barrier, an R-Screen barrier, a pitch-back barrier, etc. With barriers comprised of a net or netting, the fastener may be of any suitable type such as stitching that engages the connector and the net in more than one location to capture the grid-like structure surrounding the opening in the barrier, or slip-rings, tie-downs, weave-throughs, cords, elastics, etc. that capture the grid-like structure.

In other exemplary embodiments, at least a portion of the barrier may be made of any suitable material such as netting, canvas fabric, screen fabric (see-thru or not), poly mesh, trampoline mesh (including polypropylene trampoline fabric), impact-resistant perforated poly sheet, and the like.

In some embodiments, the receiving anchor is a portion of the object projecting device and has at least one catch that receives and secures the connector when in the connection mode. The at least one catch may be a lip such as a rim or flange or groove, or the neck that may define the exit opening, or hook(s), tab(s), or barb(s), or any combination thereof.

Additionally, exemplary harness connection systems may further comprise a retractor assembly having a retractor connected to the barrier and a retractor receiver. The retractor being connected to the barrier at a first location typically above the connector so that the retractor may reduce sagging of the barrier when the retractor is retracted and engages the retraction receiver which is located at a second location. This second location may be somewhere on the object projecting device (such as around the housing 34), a different location on the barrier, or secured to some stationary structure other than the object projecting device such as a tree, fence, pole, backstop, or the like. The purpose of the retractor is to pull the retractor and the connected barrier in a direction that will reduce or eliminate any sagging of the barrier so that the barrier does not interfere with a flight path of any object projected from the object projecting device.

The embodiments of this invention have been developed in response to the present state of the art, and in particular, in response to problems and needs in the art that have not yet been fully solved by currently available harness systems.

It is an improvement to provide a harness system that is advanced, yet simple and cost-effective in connecting a barrier to an object projecting device.

Further, it would be an advance to provide harness systems that may be manufactured and sold together as a kit with a barrier and an object projecting device.

It would also be an advance to provide harness systems that may be retrofit easily with existing barriers and/or various-sized and configured object projecting devices.

These and other features of the exemplary embodiments of the present invention will become more fully apparent from the following description, or may be learned by the practice of the invention as set forth hereinafter.

BRIEF DESCRIPTION OF THE DRAWINGS

The present invention is described more fully hereinafter with reference to the accompanying drawings, in which various exemplary embodiments of the invention are described and shown. Like numbers used herein refer to like elements throughout. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting the scope of the invention, which is to be given the full breadth of the appended claims and any and all equivalents thereof. Moreover, many embodiments, such as adaptations, variations, modifications, and equivalent arrangements, will be implicitly disclosed by the exemplary embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list. Additionally, the terms "operator", "user", and "individual"

may be used interchangeably herein unless otherwise made clear from the context of the description.

Figure 1:
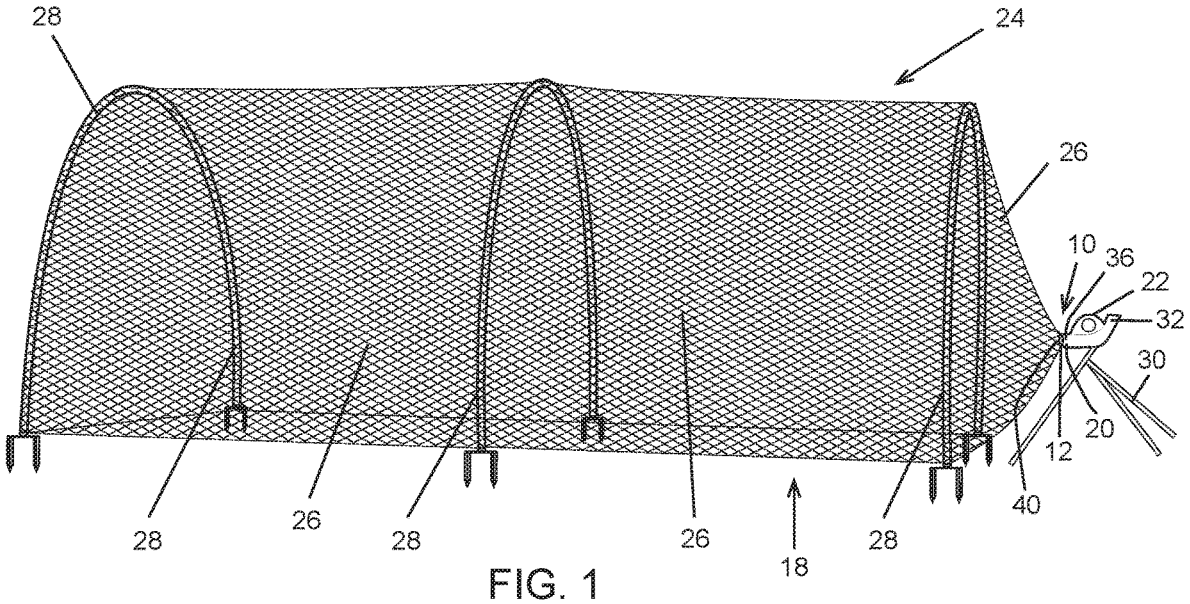
Figure 2:
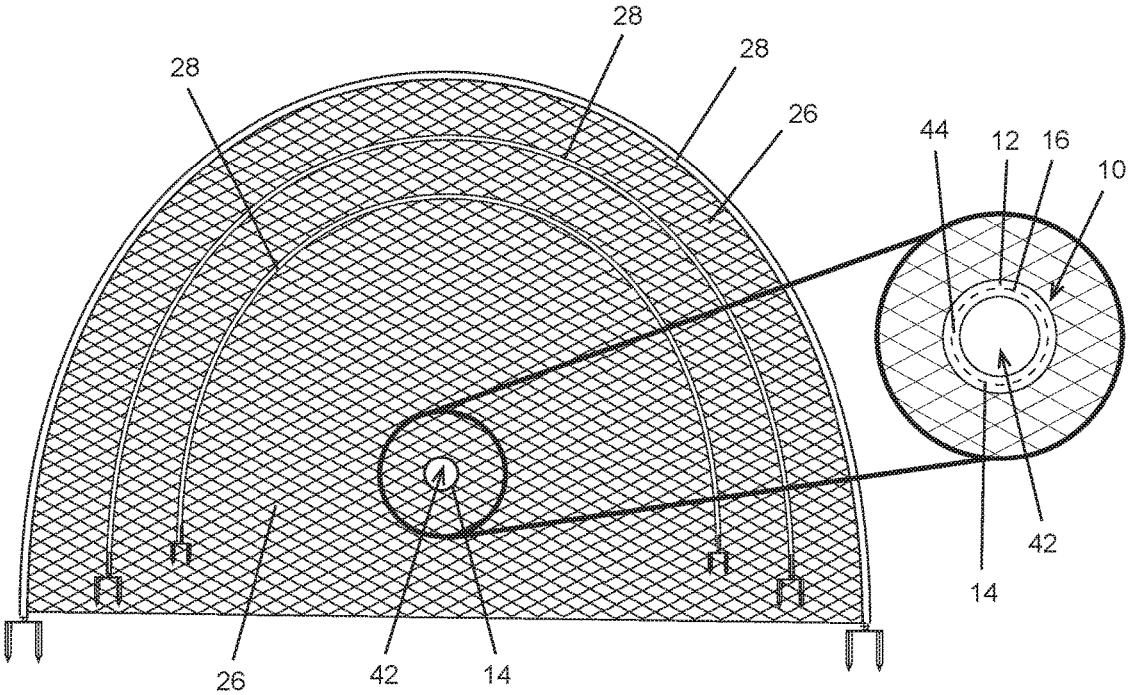
Figure 3:
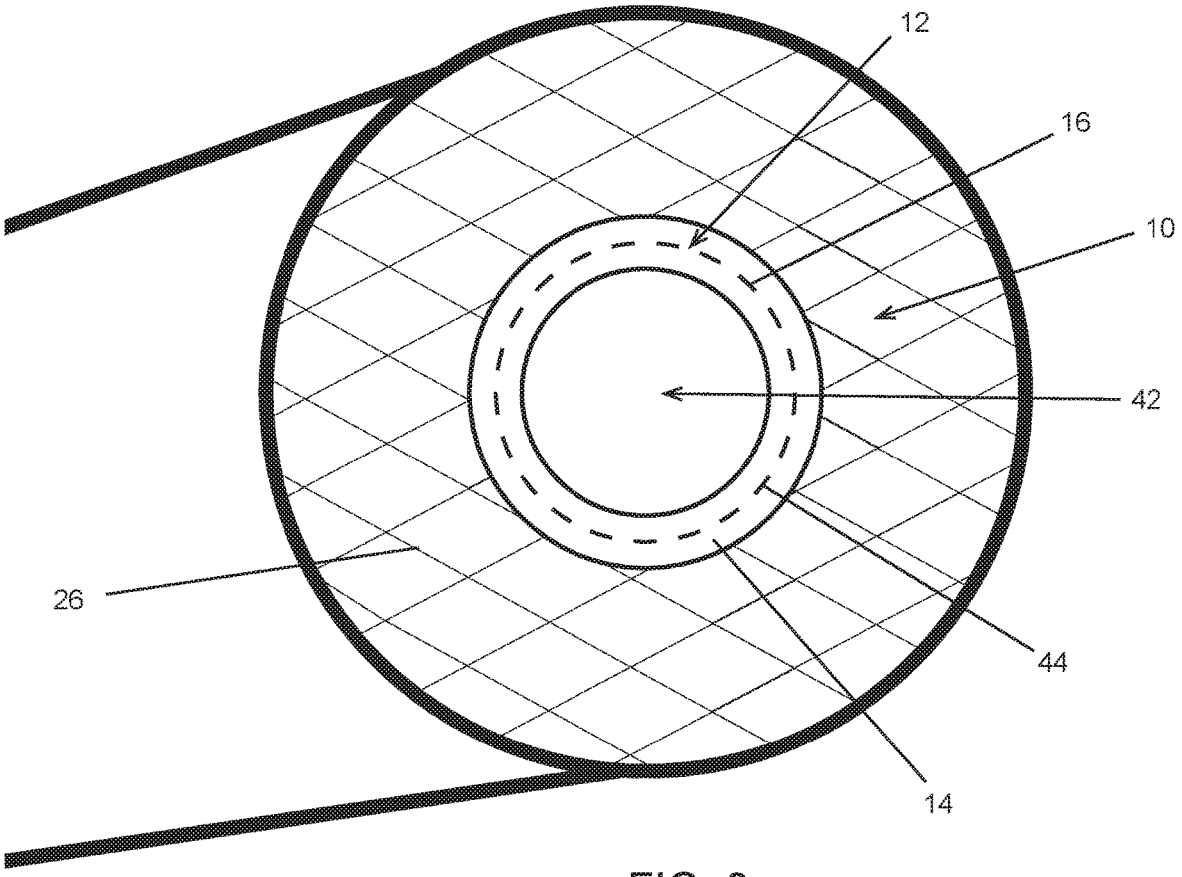
Figure 4:
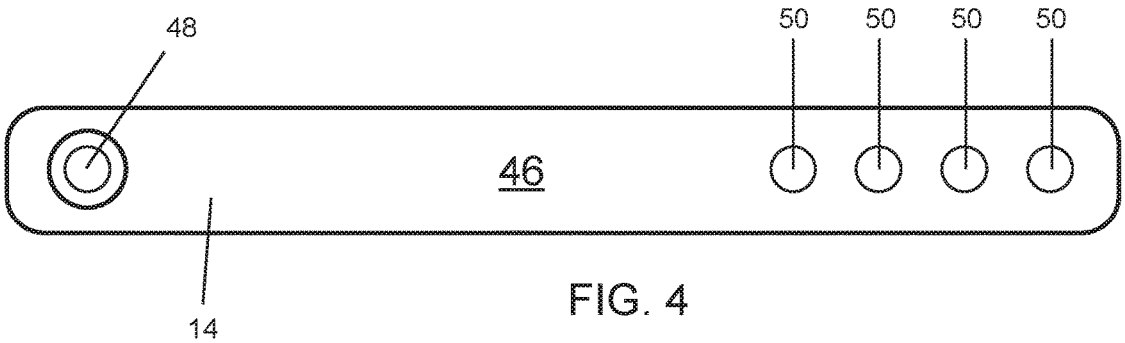
Figure 5:
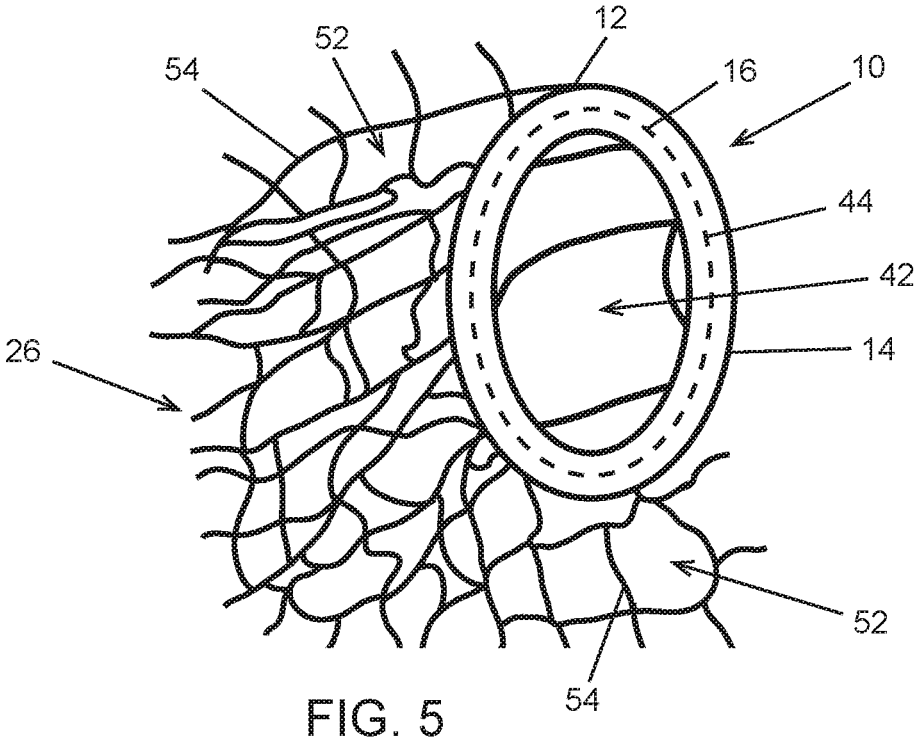
Figure 6:
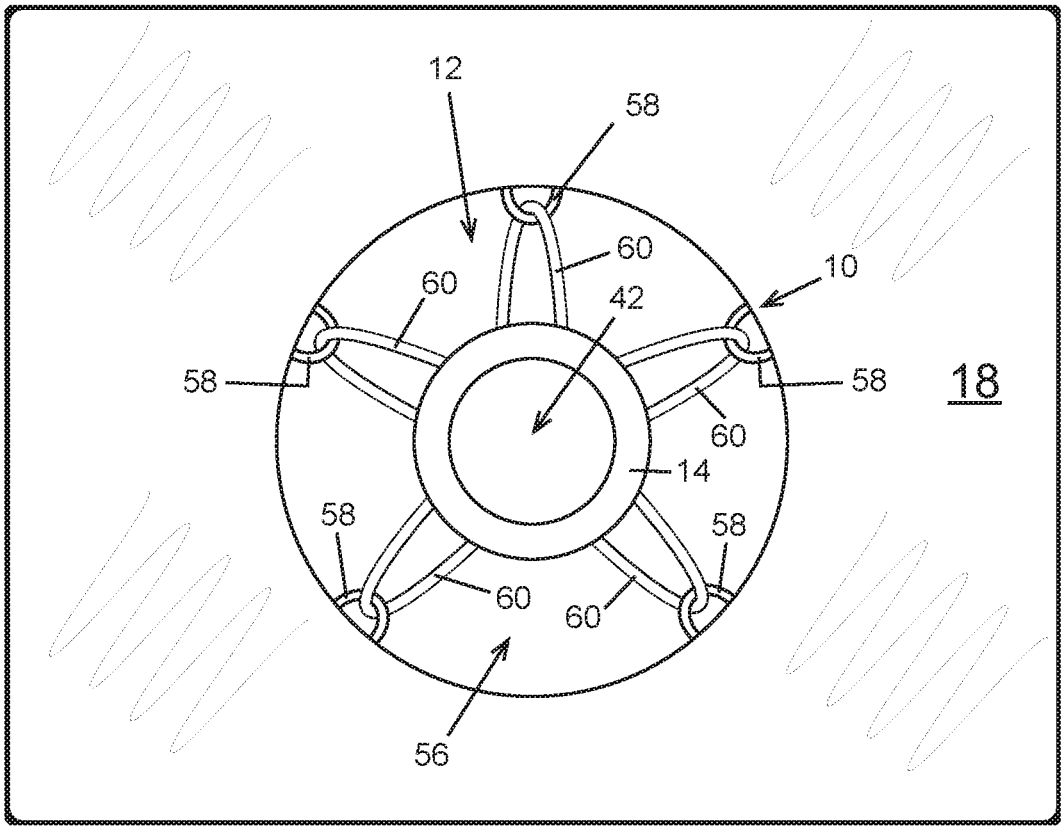
Figure 7:
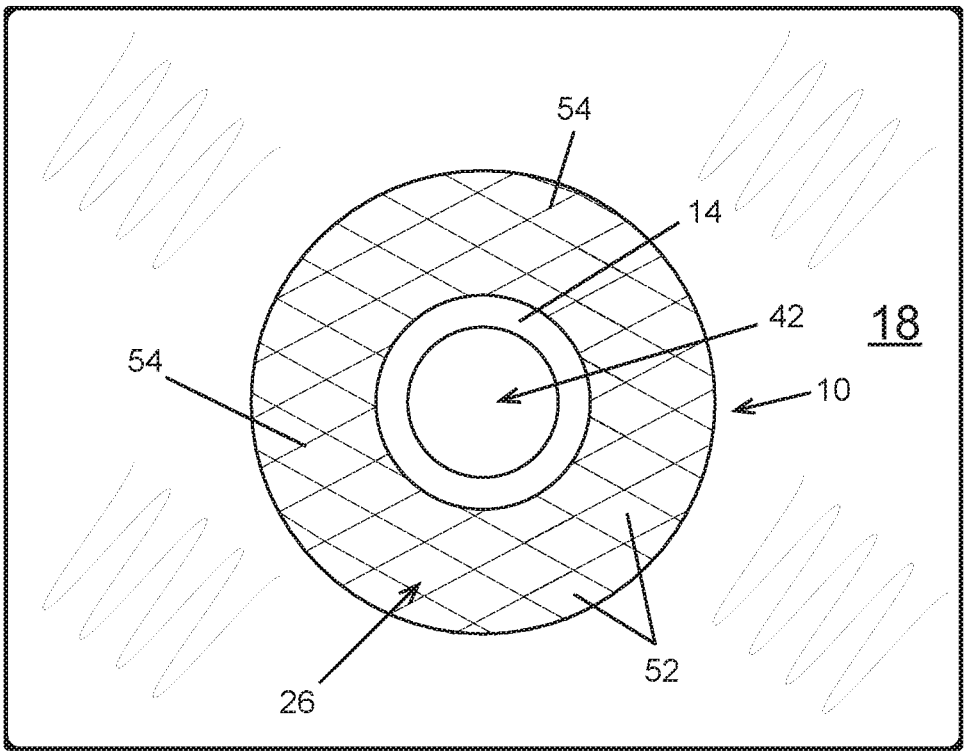
Figure 8:
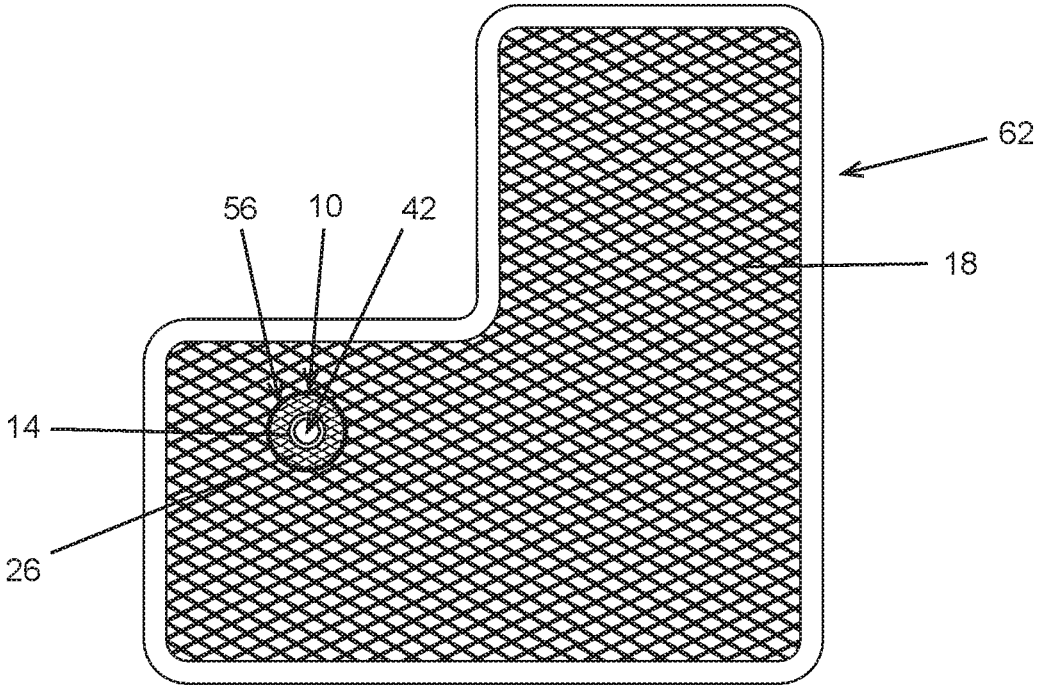
Figure 9:
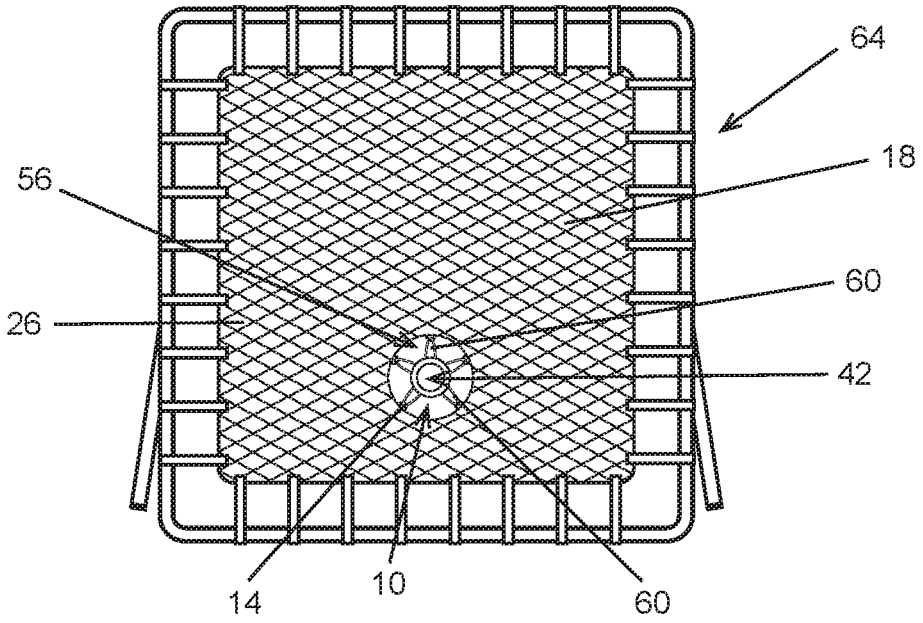
Figure 10:
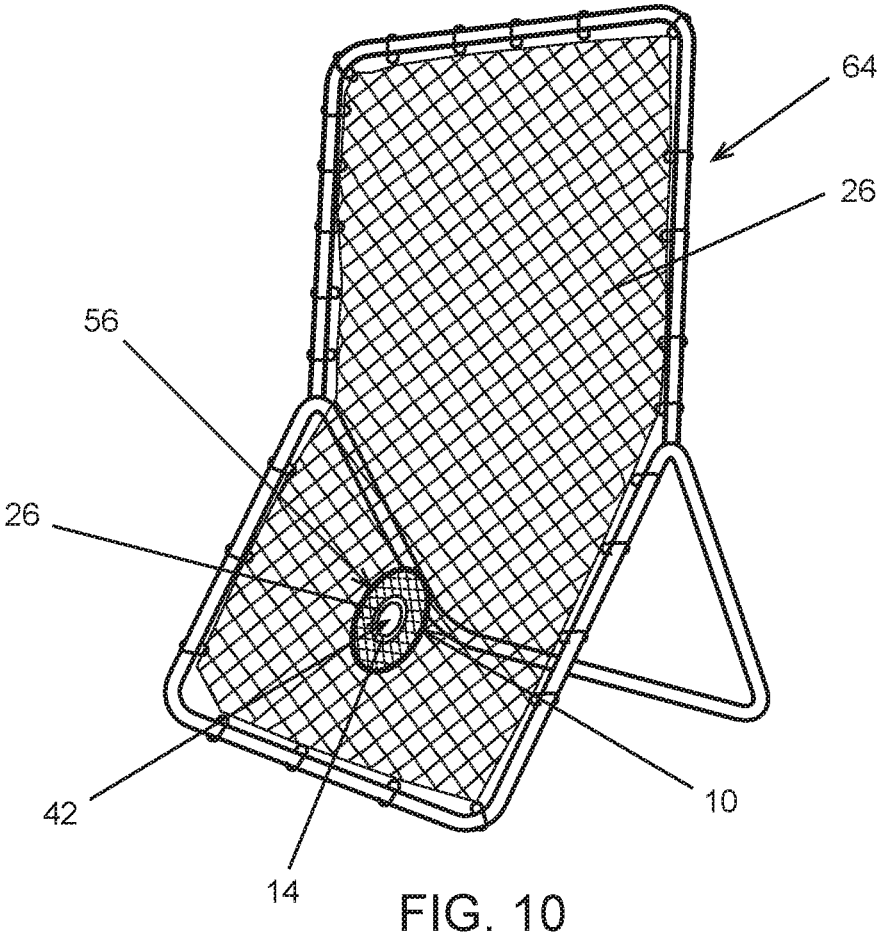
Figure 11:
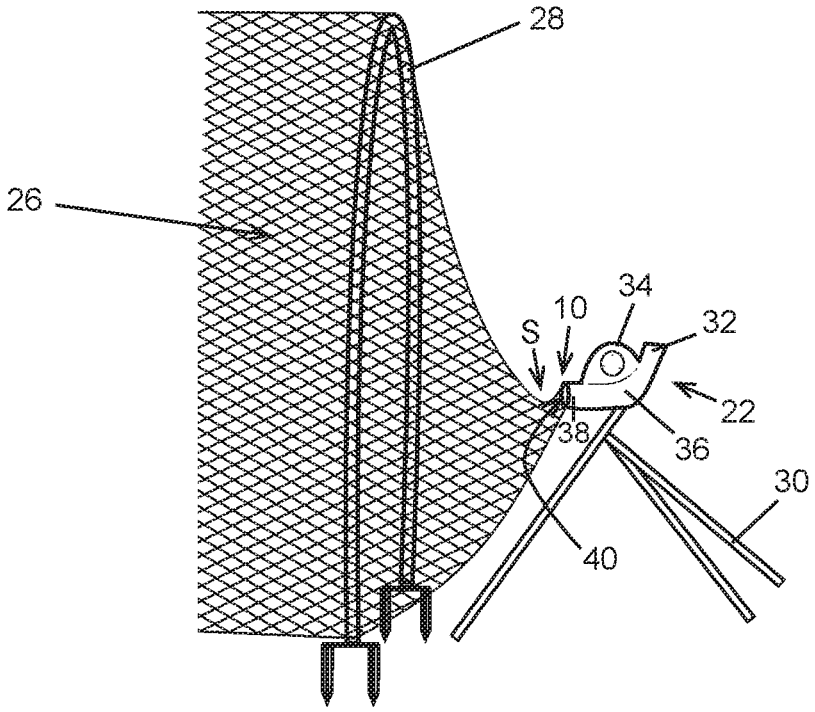
Figure 12:
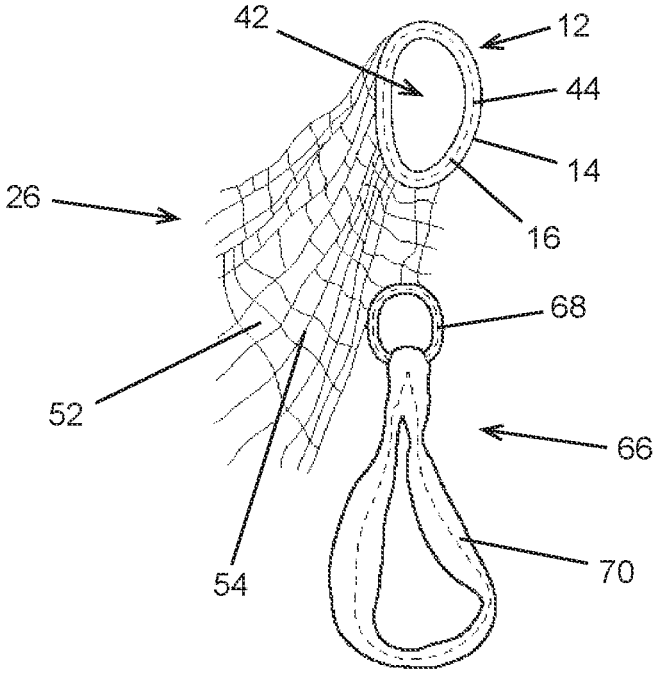
Figure 13:
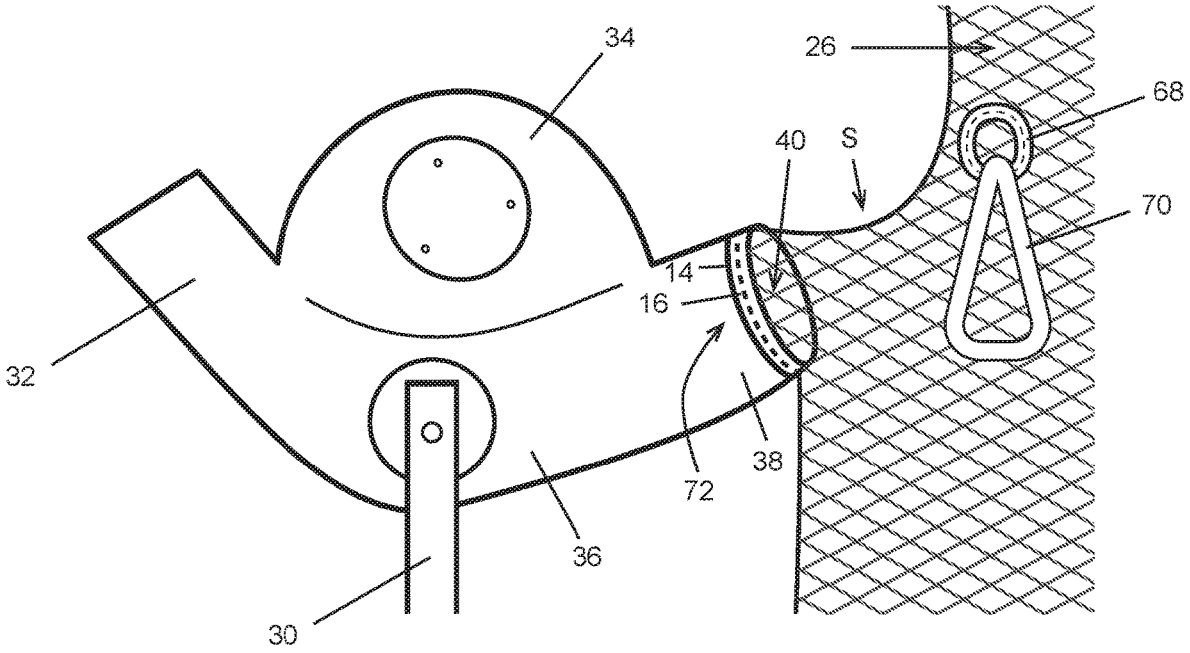
Figure 14:
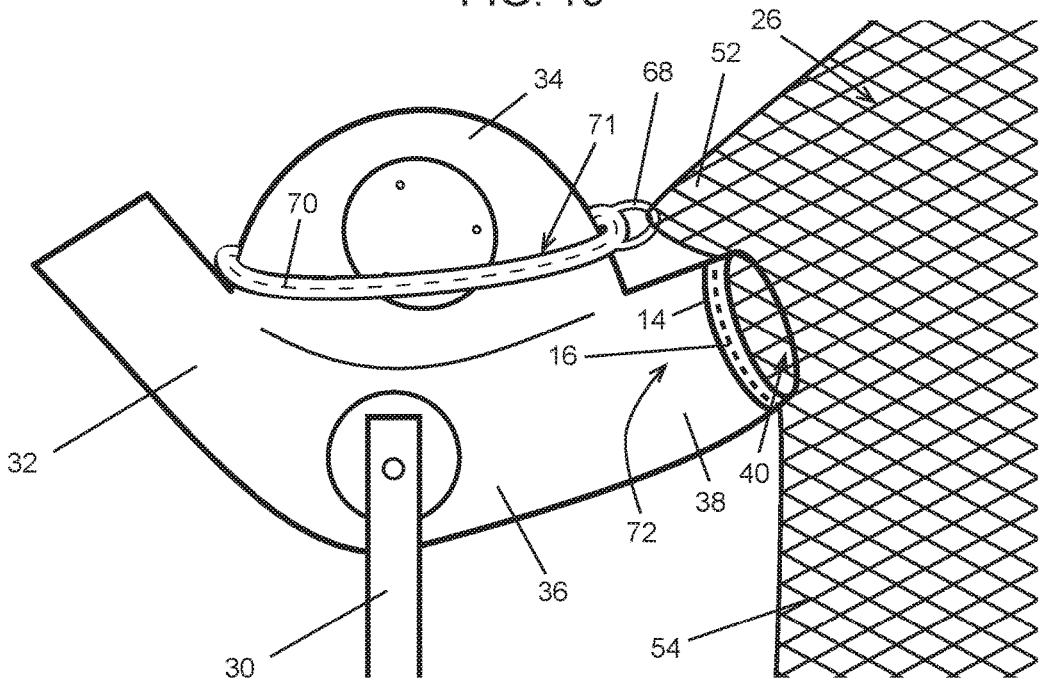
Figure 15:
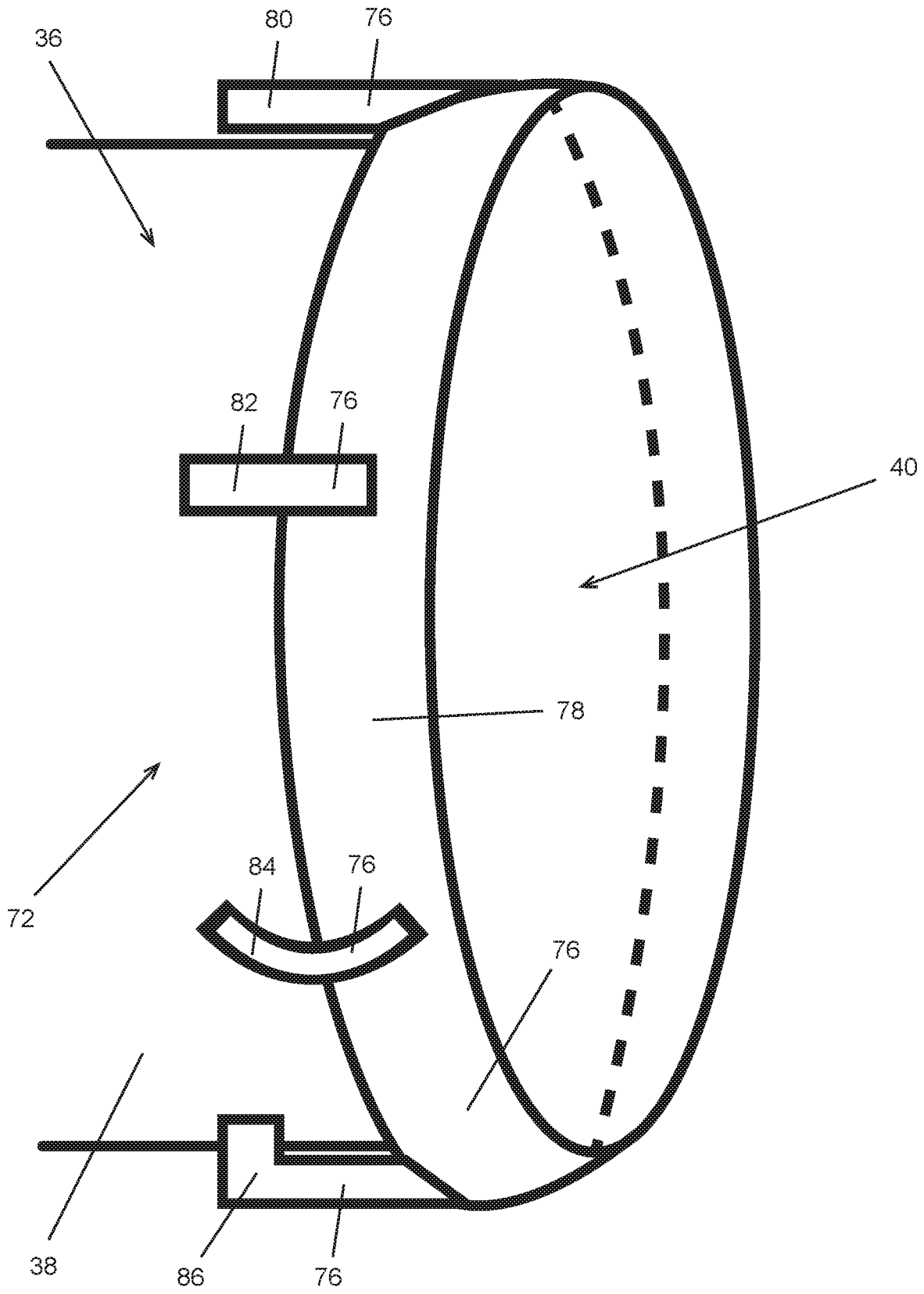
Figure 16:
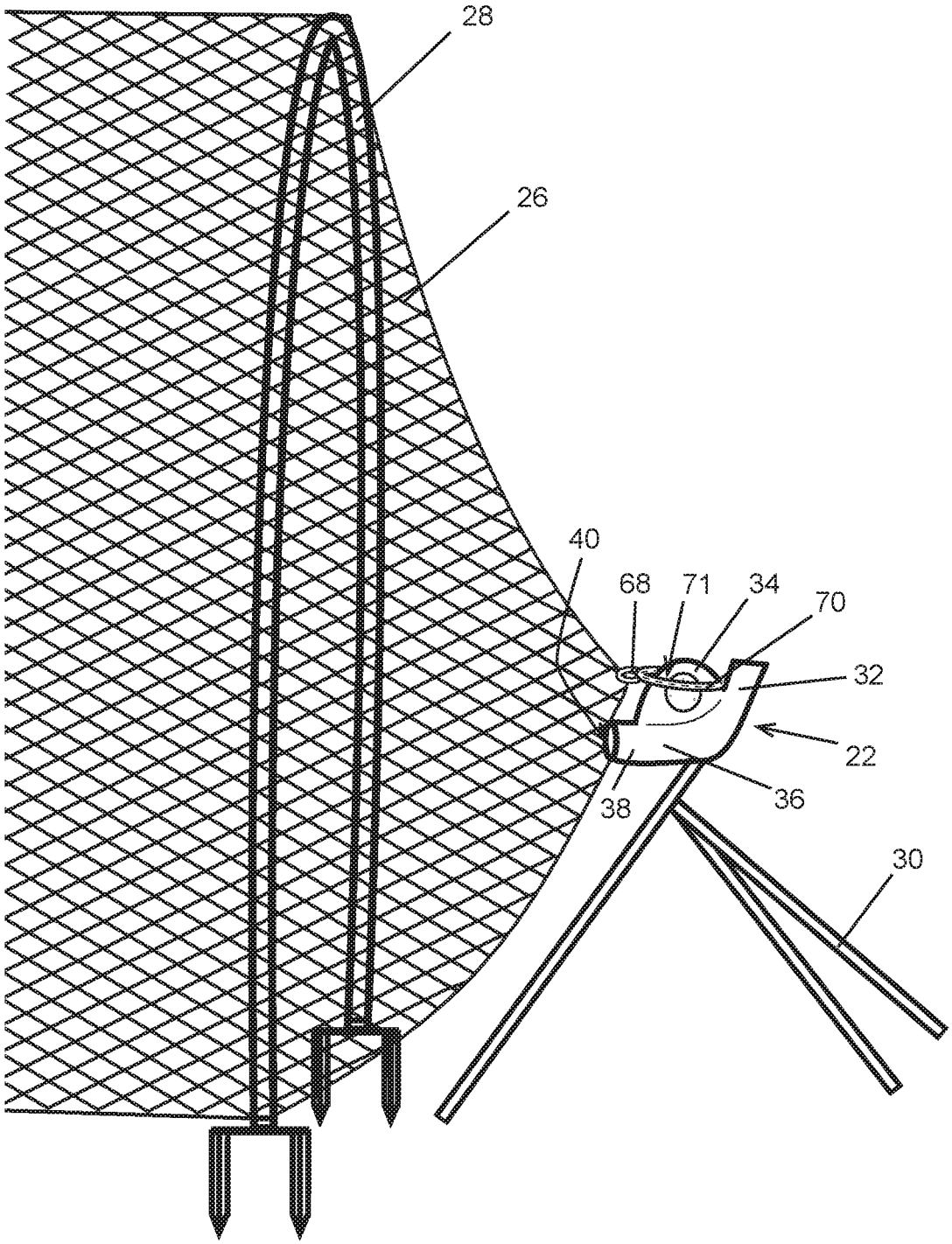

Understanding that these drawings depict only typical exemplary embodiments of the invention and are not therefore to be considered to be limiting of its scope, the invention will be described and explained with additional specificity and detail through the use of the accompanying drawings in which:

FIG. 1 is a perspective view of an exemplary embodiment of an object projecting device connected to a cage-type barrier of netting;

FIG. 2 is an end view of an exemplary cage-type barrier showing an exemplary harness disposed within barrier netting and an enlarged view of the region of the barrier around the harness;

FIG. 3 is an enlarged view of the region of the cage-type barrier of FIG. 2 around the harness, showing an exemplary connector and an exemplary fastener securing the connector to the barrier;

FIG. 4 is a plan view of another exemplary connector having an adaptable periphery;

FIG. 5 is a perspective view of a portion of exemplary barrier netting with an exemplary connector secured to the barrier by an exemplary fastener;

FIG. 6 is an elevation view of an alternative exemplary barrier with an opening, showing an exemplary connector secured within the opening to the barrier using an alternative exemplary fastener;

FIG. 7 is an elevation view of another exemplary barrier with an opening, showing an exemplary connector secured within the opening to the barrier using an alternative exemplary, combination fastener;

FIG. 8 is an elevation view of an exemplary, L-screen barrier with an opening, showing an exemplary connector secured within the opening to the barrier using an alternative exemplary, combination fastener;

FIG. 9 is an elevation view of an exemplary, pitch-back barrier with an opening, showing an exemplary connector secured within the opening to the barrier using an exemplary, combination fastener;

FIG. 10 is a perspective view of another exemplary, pitch-back barrier with an opening, showing an exemplary connector secured within the opening to the barrier using an exemplary, combination fastener;

FIG. 11 is a schematic, elevation view of an end portion of an exemplary cage-type barrier, showing sagging netting obstructing the exit opening in a connected object projecting device;

FIG. 12 is a perspective view of a portion of exemplary barrier netting with an exemplary connector secured to the barrier by an exemplary fastener and showing an exemplary retractor connected to the barrier netting;

FIG. 13 is a schematic, elevation view of an end portion of an exemplary cage-type barrier, showing sagging netting obstructing the exit opening in a connected object projecting device and an exemplary retractor in an unanchored disposition;

FIG. 14 is a schematic, elevation view of the end portion of the exemplary cage-type barrier of FIG. 13, showing the exemplary retractor anchored about a portion of the connected object projecting device to remove the obstruction of the exit opening in a connected object projecting device by pulling the sagging portion of the barrier netting away from the exit opening;

FIG. 15 is a perspective view of a representative region about the exit opening of an exemplary object projecting device illustrative various exemplary forms of receiving anchors; and FIG. 16 is a schematic, elevation view of the end portion of an exemplary cage-type barrier in the connection mode, showing the exemplary retractor anchored about a portion of the connected object projecting device to remove the obstruction of the exit opening in a connected object projecting device by pulling a sagging portion of the barrier netting away from the exit opening.

REFERENCE NUMERALS

| | |
|---|---|
| harness system(s) 10 | harness 12 |
| connector 14 | fastener 16 |
| barrier 18 | receiving anchor 20 |
| object projecting device 22 | cage-type barrier 24 |
| net or netting 26 | structural arch(es) 28 |
| tripod 30 | feeder chute 32 |
| housing 34 | projecting chute 36 |
| neck 38 | exit opening 40 |
| opening 42 | stitching 44 |
| strap 46 | female receptor 48 |
| male post(s) 50 | interstices 52 |
| cords 54 | barrier opening 56 |
| barrier ring(s) 58 | resilient band(s) 60 |
| L-screen barrier 62 | pitch-back barrier 64 |
| retractor 66 | attachment 68 |
| retractor strap 70 | retraction receiver 71 |
| receiving anchor(s) 72 | catch(es) 76 |
| lip 78 | stop 80 |
| tab 82 | curved hook 84 |
| arm and ear hook 86 | sagging or sagging portion S |

DETAILED DESCRIPTION OF THE INVENTION

The exemplary embodiments of the present disclosure will be best understood by reference to the drawings, wherein like parts are designated by like numerals throughout. It will be readily understood that the components of the exemplary embodiments of the present invention, as generally described and illustrated in the figures herein, could be arranged and designed in a wide variety of different configurations. Thus, the following more detailed description of the exemplary embodiments, as represented in the figures, is not intended to limit the scope of the invention, as claimed, but is merely representative of exemplary embodiments of the disclosure.

It should be noted that in order to make the drawings as clear as possible, some reference numbers may be omitted in some figures so not to obscure other reference numbers or features of the exemplary embodiments. Where reference numbers are omitted, representative reference numbers will be provided on one or more other figures so that the drawings may be understood readily by those skilled in the art.

In this application, the phrases "connected to", "coupled to", and "in communication with" refer to any form of interaction between two or more entities, including mechanical, capillary, electrical, magnetic, electromagnetic, pneumatic, hydraulic, fluidic, and thermal interactions. One item may be connected to another item although they do not touch directly.

The phrases "attached to", "secured to", and "mounted to" refer to a form of mechanical coupling that restricts relative translation or rotation between the attached, secured, or mounted objects, respectively. The phrase "slidably attached to" refer to a form of mechanical coupling that permits relative translation, respectively, while restricting other relative motions. The phrase "attached directly to" refers to a form of securement in which the secured items are in direct contact and retained in that state of securement.

The term "abut" and its formatives including "abutting" refers to items that are in direct physical contact with each other, although the items may not be attached together. The term "grip" refers to items that are in direct physical contact with one of the items firmly holding the other. The term "integrally formed" refers to a body that is manufactured as a single piece, without requiring the assembly of constituent elements. Multiple elements may be integrally formed with each other, when attached directly to each other from a single work piece. Thus, elements that are "coupled to" each other may be formed together as a single piece.

FIGS. 1-16 depict various exemplary components and embodiments of a harness system 10. Each exemplary harness systems 10 has a harness 12 with a connector 14, a fastener 16 that secures the connector 12 to a barrier 18, and a receiving anchor 20.

FIG. 1 is a perspective view of an environment in which an exemplary embodiment of an object projecting device 22 is connected, using the harness system 10, to a cage-type barrier 24 made of netting 26 and structural arches 28. The exemplary object projecting device 22 is supported by a tripod 30 and has an object feeder chute 32, a housing 34 for a motor (not visible), and a projecting chute 36 that has a neck 38 and an exit opening 40 (see FIGS. 11 and 13-16). The harness system 10 connects the cage-type barrier 24 to the object projecting device 22 at the neck 38.

FIG. 2 is an end view of an exemplary cage-type barrier 24 showing an exemplary harness 12 disposed within barrier netting 26. An enlarged view of the region (FIGS. 2 and 3) of the barrier 18 around the harness 12 depicts an exemplary connector 14 secured to the netting 26 by an exemplary fastener 16. The interior of connector 12 defines an opening 42 in the netting 26 through which a portion of the projecting chute 36 may be passed so that the exit opening 40 is disposed within the cage-type barrier 24 while most of the object projecting device 22 is safely outside the cage-type barrier 24 (see FIG. 1 for context).

The exemplary fastener 16 is stitching 44 that sews portions of the netting 26 bordering the hole (not specifically depicted) in the barrier 18 into or onto the exemplary connector 14. In this instance, portions of the netting 26 engage and are secured to the connector 14 in more than one location disposed around the circular exemplary connector 14. It should be understood that the fastener 16 depicted as stitching 44 may also include an adhesive and/or a heat seal to further secure the netting 26 to the connector 14 by reducing strain on the stitching 44 and pull on the netting 26.

The exemplary connector 14 is resilient and/or elastomeric so that the opening 42 which is generally the same size or smaller than the exit opening 40 (while in the non-connection mode) will permit the forwardmost portion of the projecting chute 36 can pass through the opening 42 and constrict about the neck 38 to secure the connector 14 to the object projecting device 22 (while in the connection mode). Hence, the size of the opening 42 while in the non-connection mode (a first size) differs from the size of the opening 42 while in the connection mode (a second size) so that the constriction will have sufficient clamping force to secure the connector 14 to the object projecting device 22.

Referring now to FIG. 4, a plan view of another exemplary connector 14 is depicted. Exemplary connector 14 is a strap 46 of finite length and finite adjustability. Nevertheless, the strap 46 may be fashioned into a loop having an adaptable periphery. The exemplary strap 46 has a single female receptor 48 that may receive one of a plurality of spaced male posts 50 in attachable/detachable engagement to form a loop having a periphery. In this manner, the strap 46 may have a finite number of peripheries and adjustability of those peripheries by attaching various of the male posts 50 to the female receptor 48. However, the exemplary strap 46 may be made of a material that is resilient or elastomeric, thereby increasing the adjustability of the peripheries. Also, the strap 46 may utilize a hook and loop (or pile) securing engagement which introduces a slightly different type and range of adaptable peripheries, whether or not the strap 46 is made of a resilient or elastomeric material.

One advantage of using a strap 46 as the connector 14 is that it simplifies the retrofit of the connector 14 to netting 26, because the strap 46 may be interwoven through interstices 52 in the netting 26 around the boundary of a hole made in the netting 26 to receive the connector 14. Once so interwoven, the strap 46 may be fashioned into a loop to create the opening 42

It should be understood that the strap 46 depicted in FIG. 4 is merely and exemplary strap 46, and is provided as a representative strap 46 only. Alternative straps 46 have been described, and should easily be understood by those skilled in the art. Additionally, any number of additional connectors 14 are contemplated as included within this disclosure, including adjustable straps of any type (such as shoelaces, twine, or any type of cinching strap that could be tied, secured by hook and loop (e.g., Velcro®), snaps, buttons, a hook and eye latch, etc.) resilient rings, elastomeric bands, or the like.

FIG. 5 is a perspective view of a portion of exemplary barrier netting 26 with an exemplary connector 14 secured to the barrier 18 by an exemplary fastener 16. In this instance, the netting 26 with cords 54 and interstices 52 is not pulled taut, so to show a connector 14 that has enough structural rigidity to hold its circular form, but still may be resilient or elastomeric. Again, the exemplary fastener 16 is stitching 44, but may also include an adhesive and/or a heat seal to further secure the netting 26 to the connector 14 by reducing strain on the stitching 44 and pull on the netting 26.

An alternative exemplary barrier 18 is depicted in FIG. 6 which is an elevation view of a portion of the barrier 18 with a barrier opening 56, showing an exemplary connector 14 secured within the barrier opening 56 using an alternative exemplary fastener 16. The alternative fastener 16 comprises an assembly of barrier rings 58 and resilient bands 60. The barrier rings 58 are attached to the barrier 18 spaced along the periphery of the barrier opening 56 in any suitable manner and may be of any suitable type such as trampoline V-rings, metal o-rings, and metal pad eyes. Each resilient band 60 passes through the eye of one of the barrier rings 58 and is attached to and/or connects with the connector 14 in any suitable manner such as by adhesive, stitching, rings, etc. or any combination thereof. The resilient band 60 may be elastomeric, a spring, or any structure that allows for movement of the connector 14 but inhibits an object from passing through the barrier opening 56, except for the intended passage of objects through the opening 42 in the connector by being projected therethrough by an object projecting device 22.

FIG. 7 is an elevation view of another exemplary barrier 18, similar to the barrier 18 with a barrier opening 56 shown in FIG. 6, except that the fastener 16 that connects the exemplary connector 14 to the barrier 18 using an alternative exemplary, combination fastener 16, comprising a netting 26 that is secured to the barrier 18 at the periphery of the barrier opening 56 and the connector 14 in any suitable manner, including adhesive, stitching, and the like and any combination thereof.

FIG. 8 is an elevation view of an exemplary, L-screen barrier 62 with a barrier opening 56, showing an exemplary connector 14 secured within the barrier opening 56 using an exemplary, combination fastener 16. The L-screen barrier 62 is shaped in an "L" similar to L-shaped baseball pitching screens known in the art. The barrier 18 portion the L-screen barrier 62 may comprise any of a number of materials such as chain-link, wire mesh, netting or the like. In the instance shown, the combination fastener 16 is a type of netting 26 that has smaller interstices 52 than those in the barrier 18. The fastener 16 depicted is netting 26 that is secured to the barrier 18 at the periphery of the barrier opening 56 and the connector 14 in any suitable manner, including adhesive, stitching, and the like and any combination thereof.

FIG. 9 is an elevation view of an exemplary, pitch-back barrier 64 with a barrier opening 56, showing an exemplary connector 14 secured within the barrier opening 56 to the barrier using an alternative exemplary, combination fastener 16. The pitch-back barrier 64 depicted has a netting 26 barrier 18, but may have any of a number of barrier 18 types, such as netting 26 (as shown), screen fabric (see-thru or not), poly mesh, trampoline mesh (including polypropylene trampoline fabric), and the like. The fastener 16 depicted utilizes resilient bands 60 secured to the barrier 18 at the periphery of the barrier opening 56 and the connector 14 in any suitable manner, including adhesive, stitching, metal rings, and the like and any combination thereof.

Similarly, FIG. 10 is a perspective view of another exemplary, pitch-back barrier 64 with a barrier opening 56, showing an exemplary connector 14 secured within the barrier opening 56 using a netting-type fastener 16. Again, the pitch-back barrier 64 depicted has a netting 26 barrier 18, but may have any of a number of barrier 18 types, such as netting 26 (as shown), screen fabric (see-thru or not), poly mesh, trampoline mesh (including polypropylene trampoline fabric), and the like. The fastener 16 depicted is netting 26 with smaller interstices 52 that is secured to the barrier 18 at the periphery of the barrier opening 56 and the connector 14 in any suitable manner, including adhesive, stitching, and the like and any combination thereof.

FIG. 11 is a schematic, elevation view of an end portion of an exemplary cage-type barrier 24, showing netting 26 sagging (depicted by S) obstructing the exit opening 40 in a connected object projecting device 22. FIG. 11 illustrates a problem encountered by barriers 18 over time as the netting 26 or some other barrier material stretches and may sag. Such sagging S renders the cage-type barrier 24 virtually useless, until the sagging S is remedied.

A portion of exemplary barrier netting 26 is shown in FIG. 12 with an exemplary connector 14 secured to the barrier 18 using an exemplary fastener 16 (see FIG. 5 and the description related thereto) and showing an exemplary retractor 66 connected to the barrier netting 26. As shown, the retractor 66 is spaced from the connector 14 in the general region of sagging S above the connector 14. By creating a pulling force on the netting 26 via the retractor 66, the netting 26 can be drawn away from the exit opening 40 to remove the sagging S. The retractor 66 depicted comprises an attachment 68 and a retractor strap 70. The attachment 68 may be of any suitable type, permanent or non-permanent, such as a ring, a split ring, a resilient loop, a tie such as a shoelace or twine, a zip-tie, and the like. Although the retractor 66 depicted has an attachment 68, it should be understood that the retractor 66 need not require an attachment 68. The retractor strap 70 may be of any functional type capable of drawing the netting 26 away to reduce or eliminate sagging S, by way of example and not by limitation, the retractor strap 66 may be a loop attached directly to the netting 26 or it may be a strap tied to the netting 26 or it may be woven through one or more interstices 52 in the netting 26.

FIGS. 13 and 14 are schematic, elevation views of an end portion of an exemplary cage-type barrier 64 with a retractor 66 connected to the netting 26. FIG. 13 shows the netting 26 sagging S to obstruct the exit opening 40 in a connected object projecting device 22 and the retractor 66 in an unanchored disposition. FIG. 14 shows the retractor 66 anchored about a portion of the connected object projecting device 22 to eliminate the sagging S and remove the obstruction of the exit opening 40 of the object projecting device 22 by pulling the sagging portion S of the barrier 18 netting 26 away from the exit opening 40.

The purpose of the retractor 66 is to pull the sagging S portion of the barrier 18 in a direction that will reduce or eliminate any sagging S of the barrier 18 so that the barrier 18 does not interfere with a flight path of any object projected from the object projecting device 22.

Although the retractor 66 is shown as expandable and anchored to the object projecting device 22, it should be understood that the retractor 66 may be secured to anything that will create the pulling force needed to eliminate the sagging S and remove the obstruction of the exit opening 40. For example, the retractor 66 may be secured to a different location (a on the barrier 18 or to some stationary structure other than the object projecting device 22 such as a tree, fence, pole, backstop, or the like.

FIG. 15 is a perspective view of a representative region about the exit opening 40 of an exemplary object projecting device 22 illustrating various exemplary forms of receiving anchors 72. The representative region depicted is the forwardmost portion of the neck 38 with several exemplary catches 76 that assist is capturing the connector 14 when the connector 14 is in the connection mode. The catches 76 depicted include a lip 78 (or flange or rib), a stop 80, a tab 82, a curved hook 84, and an arm and ear hook 86. To secure the connector 14 to the object projecting device 22 so that the exit opening 40 passes through the barrier 18, the connector 14 is expanded to pass over the neck 38 and is allowed to constrict about the neck 38. The neck 38 is one form of receiving anchor 72, the neck 38 with a groove (not shown) that allows further constriction may serve as another type of receiving anchor 72. Slidably moving the connector 14 along the neck 38 to abut against the lip 78 will secure the connector 14 from being dislodged inadvertently. The combination of the neck 38 and the lip 78 is another form of receiving anchor 72. The neck 38 and other catches 76, used in combination with the lip 78 or without the lip 78, are additional forms of receiving anchors 72. It should be understood that receiving anchor 72 should be interpreted broadly to mean any structure that receives the connector 14 in securement with the object projecting device 22, and such structures are contemplated as within the scope and spirit of this disclosure.

FIG. 16 is a schematic, elevation view of the end portion of an exemplary cage-type barrier 24 in the connection mode, showing the exemplary retractor 66 anchored about the housing 34 of the object projecting device 22 to remove the obstruction of the exit opening 40 in the object projecting device 22 by pulling a sagging portion S of the barrier 18 netting 26 away from the exit opening 40.

A harness system 10 may be attached to a combination of a net 26 and an object projecting device 22 to facilitate the connection of the net 26 to the object projecting device 22 so that an object may be projected from the exit opening 40 in the object projecting device 22 and passed through the net 26. First, a location is located where a barrier opening 56 in the net 26 is desired and the size of the barrier opening 56 in the net 26 is determined so to have the size sufficient to allow the exit opening 40 to pass through the barrier 18. An area of the net 26 is removed (by cutting) from the location in the size desired. A fastener 16 is used to attach a connector 14 having an adaptable periphery to the net 26 so that the adaptable periphery defines the opening 42 through which the exit opening 40 passes through the net 26. The connector 14 is connected to the object projecting device 22 by passing the connector 14 over the exit opening 40 and securing the connector 14 to a receiving anchor 72.

The receiving anchor 72 may have at least one catch 76 that receives and secures the connector 14. The connector 14 may be advanced to the catch 76 so that the catch 76 receives and secures the connector 14.

The harness system 10 may also have a retractor 66 that is connectable to the net 26 at a position that reduces any sagging S of the net 26 when the retractor 66 is retracted taut and engages a retraction receiver 71. By retracting and securing the retractor 66 sufficiently taut that any sagging S of the net 26 is reduced so the net 26 does not interfere with a flight path of any object projected from the object projecting device 22 when the retractor 66 so retracted engages the retraction receiver 71 to secure the tautness of the net 26.

It should be understood that the modular mix and match capability of the harness system(s) 10 makes any number of configuration combinations possible and may be desirable for any number of reasons depending upon the nature of the barrier 18 and object projecting device 22 and whether the type of use is a retrofit to existing barrier 18 and object projecting device 22 or a manufacture as a kit. The versatility provided by numerous configuration and modular combinations being possible is a capability not previously available to this extent in the sports industry.

Those skilled in the art will appreciate that the present embodiments are only exemplary. The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

While specific embodiments and applications of the present invention have been illustrated and described, it is to be understood that the invention is not limited to the precise configuration and components disclosed herein. Various modifications, changes, and variations which will be apparent to those skilled in the art may be made in the arrangement, operation, and details of the methods and systems of the present invention disclosed herein without departing from the spirit and scope of the invention.

The invention claimed is:

1. A harness connection system for connecting a barrier to an object projecting device to permit the object to be projected from an exit opening in the object projecting device and passed through the barrier, comprising:

a harness comprising a connector having an adaptable periphery and a fastener securing the connector to the barrier, the barrier having an opening, the opening has a size defined by the adaptable periphery of the connector and being large enough to permit at least a portion of the object projecting device to pass through the barrier, the connector having a non-connection mode and a connection mode;

a receiving anchor, the receiving anchor being at least a portion of the object projecting device, the portion of the object projecting device serving as the receiving anchor comprises a lip proximate the exit opening, the receiving anchor receives and secures the connector when in the connection mode; and wherein the size of the opening in the barrier has a first size when the connector is in the non-connection mode and the size of the opening in the barrier has a second size when the connector is in the connection mode.

2. The harness connection system of claim 1 wherein the adaptable periphery of the connector is resilient.

3. The harness connection system of claim 1 wherein the barrier is a net and wherein the fastener attaches the connector to the net by engaging the connector and the net in more than one location.

4. The harness connection system of claim 2 wherein at least a portion of the resilient adaptable periphery of the connector is elastomeric.

5. The harness connection system of claim 2 wherein the resilient connector constricts without cinching about the receiving anchor with a clamping force that secures the connector with the receiving anchor.

6. The harness connection system of claim 1 wherein the receiving anchor has at least one catch that receives and secures the connector when in the connection mode.

7. The harness connection system of claim 1 further comprising a retractor connected to the barrier and a retractor receiver, the retractor being connected to the barrier at a location that reduces any sagging of the barrier when the retractor is retracted and engages the retraction receiver.

8. The harness connection system of claim 1 further comprising a retractor connected to the barrier and a retractor receiver, the retractor being connected to the barrier at a first location and the retractor receiver is located at a second location such that any sagging of the barrier is reduced so that the barrier does not interfere with a flight path of any object projected from the object projecting device when the retractor is retracted and engages the retraction receiver at the second location.

9. The harness connection system of claim 8 wherein the retractor receiver is a portion of the object projecting device.

10. A harness connection system for connecting a net to an object projecting device to permit the object to be projected from an exit opening in the object projecting device and passed through the net, comprising:

a harness comprising a connector having a resilient periphery and a fastener securing the connector to the net, the net having an opening, the opening has a size defined by the resilient periphery of the connector and being large enough to permit at least a portion of the object projecting device to pass through the net, the connector having a non-connection mode and a connection mode;

a receiving anchor, the receiving anchor being at least a portion of the object projecting device, the portion of the object projecting device serving as the receiving anchor comprises a lip proximate the exit opening, the receiving anchor receives and secures the connector when in the connection mode; and wherein the size of the opening in the net has a first size when the connector is in the non-connection mode and the size of the opening in the net has a second size when the connector is in the connection mode.

11. The harness connection system of claim 10 wherein at least a portion of the resilient periphery of the connector is elastomeric.

12. The harness connection system of claim 10 wherein the connector constricts without cinching about the receiving anchor with a clamping force that secures the connector with the receiving anchor.

13. The harness connection system of claim 10 wherein the receiving anchor has at least one catch that receives and secures the connector when in the connection mode.

14. The harness connection system of claim 10 further comprising a retractor connected to the net and a retractor receiver, the retractor being connected to the net at a first location that reduces any sagging of the net when the retractor is retracted and engages the retraction receiver.

15. The harness connection system of claim 10 further comprising a retractor connected to the net and a retractor receiver, the retractor being connected to the net at a first location and the retractor receiver is located at a second location such that any sagging of the net is reduced so that the net does not interfere with a flight path of any object projected from the object projecting device when the retractor is retracted and engages the retraction receiver at the second location.

16. The harness connection system of claim 10 wherein the retraction receiver is a portion of the object projecting device.

17. A method of attaching a harness connection system to a combination of a net and an object projecting device to facilitate the connection of the net to the object projecting device to permit an object to be projected from an exit opening in the object projecting device and passed through the net, comprising the steps of:

determining a location where an opening in the net is desired and what size of opening in the net is required, the size of the opening being sufficiently sized to allow the exit opening to pass therethrough;

removing an area of the net from the location and in the size desired;

using a fastener, attach a connector having an adaptable periphery to the net so that the adaptable periphery defines the opening through which the exit opening passes through the net;

connecting the connector to the object projecting device by passing the connector over the exit opening and securing the connector to a receiving anchor, the receiving anchor comprising at least one catch for receiving the connector; and advancing the connector to the catch so that the catch receives and secures the connector.

18. The method of claim 17 wherein the receiving anchor further comprises a lip proximate the exit opening.

19. The method of claim 17 further comprising the step of connecting a retractor to the net at a position that reduces any sagging of the net when the retractor is retracted taut and engages a retraction receiver.

20. The method of claim 19 further comprising the steps of retracting and securing the retractor sufficiently taut that any sagging of the net is reduced so the net does not interfere with a flight path of any object projected from the object projecting device when the retractor so retracted engages the retraction receiver to secure the tautness of the net.

* * * * *